US007309293B2

(12) United States Patent
Dunks

(10) Patent No.: US 7,309,293 B2
(45) Date of Patent: Dec. 18, 2007

(54) GOLF BALL GRIPPING DEVICE

(76) Inventor: Beatrice Dunks, 4075 Onondaga Blvd., Camillus, NY (US) 13031

( * ) Notice: Subject to any disclaimer, the term of this patent is extended or adjusted under 35 U.S.C. 154(b) by 0 days.

(21) Appl. No.: 11/307,400

(22) Filed: Feb. 6, 2006

(65) Prior Publication Data

US 2007/0184913 A1 Aug. 9, 2007

(51) Int. Cl.
*A63B 47/02* (2006.01)

(52) U.S. Cl. ..... 473/286; 294/19.2

(58) Field of Classification Search ..... 473/286, 473/296, 132–137, 298–299; 294/19.2
See application file for complete search history.

(56) References Cited

U.S. PATENT DOCUMENTS 1,830,520 A * 11/1931 Moyses ..... 294/19.2
2,801,875 A * 8/1957 McEvoy ..... 294/19.2
5,328,174 A * 7/1994 Reeder ..... 473/239
6,283,874 B1 * 9/2001 Studebaker ..... 473/227
2002/0022539 A1 * 2/2002 Smith et al. ..... 473/405

* cited by examiner

*Primary Examiner*—Stephen Blau
(74) *Attorney, Agent, or Firm*—George R. McGuire; David L. Nocilly; Bond, Schoeneck & King, PLLC

(57) ABSTRACT

A device for securely engaging and retaining a golf ball. The device is preferably adapted for secure placement on the end of the grip of a golf club, such as a putter, thus enabling a user to use the club to extend his/her reach and pick up a golf ball from the ground or from within the golf cup. The device further preferably include a mechanism for releasing the ball that may be actuated with the foot of the user, thereby permitting placement of the ball on a tee or the ground without the user having to bend.

15 Claims, 1 Drawing Sheet

GOLF BALL GRIPPING DEVICE

BACKGROUND OF THE INVENTION

The present invention relates generally to golf accessories, and more particularly to golf accessories designed to assist golfers in picking up a golf ball.

Golf is a sport that may be played and enjoyed by people regardless of age and in less than ideal physical condition. If a person has a back problems or other physical limitations brought about by knee problems, hip problems, pregnancy, weight problems, and the like, that make it undesirable to bend over, for instance when picking up a ball out of a cup or placing a ball on a tee, that person either has to have another person who will routinely perform those necessary tasks, the person has to bear the pain associated with bending, or an alternative arrangement has to be made. In the game of miniature golf which involves only the putting portion of the golf game, a person is constantly bending over to pick and place the ball, thereby exacerbating the problem.

It is therefore a principal object and advantage of the present invention to provide a device that permits a golfer to pick and place a ball without the user having to bend over.

It is another object and advantage of the present invention to be usable in combination with any golf club.

Other objects and advantages of the present invention will in part be obvious, and in part appear hereinafter.

SUMMARY OF THE INVENTION

In accordance with the foregoing objects and advantages, the present invention provides a device for securely engaging and retaining a golf ball. The device is preferably adapted for secure placement on the end of the grip of a golf club, such as a putter, thus enabling a user to use the club to extend his/her reach and pick up a golf ball from the ground or from within the golf cup. The device further preferably include a mechanism for releasing the ball that may be actuated with the foot of the user, thereby permitting placement of the ball on a tee or the ground without the user having to bend.

In its preferred form, the present invention provides a device adapted for gripping a golf ball of a predetermined diameter and for use with a golf club having a grip with an end, the device comprising a body having a longitudinal axis and first and second opposing ends; a first counter-sunk opening formed in the first end and defined by a resilient sidewall having a first diameter smaller than the predetermined diameter of the golf ball; and a second counter-sunk opening formed in the second end and adapted for secure engagement with the end of the grip. In a preferred embodiment of the invention, the resilient sidewall preferably comprises a plurality of equidistantly spaced apart ribs.

In one aspect of the present invention, it preferably further comprises a release pin movably mounted to the body and extending into the first counter-sunk opening along a first axis that is transverse to the longitudinal axis, wherein the release pin extends along a tangent that is coincident with the floor of the first counter-sunk opening. The pin may be manually, pivotally moved by a user (including by a user's foot) to push the ball out of engagement with the resilient sidewall, thereby releasing the ball from the device.

A further aspect of the invention permits the device to be used with clubs having varying grip diameters. To achieve this aspect, the device of the present invention preferably further comprises an insert adapted for secure positioning within said second counter-sunk opening, wherein the insert preferably comprises a spilt-ring. The device further comprises a set screw extending into the second counter-sunk opening and along a second axis that is transverse to said longitudinal axis. The set screw can be manually tightened into engagement with the grip to further secure the interconnection of the device on the club.

BRIEF DESCRIPTION OF THE DRAWINGS

The present invention will be further understood and appreciated by reading the following Detailed Description in conjunction with the accompanying drawings, in which.

DETAILED DESCRIPTION

Figure 1:
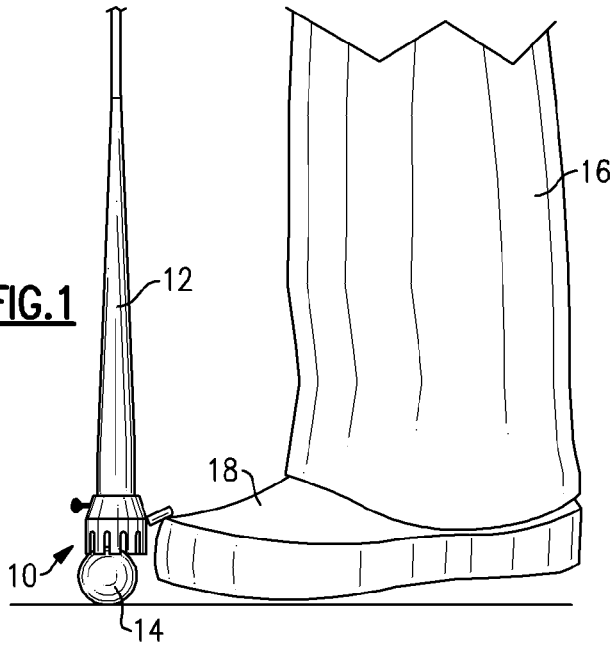
FIG. 1 is a partial side elevation view showing the present invention in use by a golfer.
Figure 2:
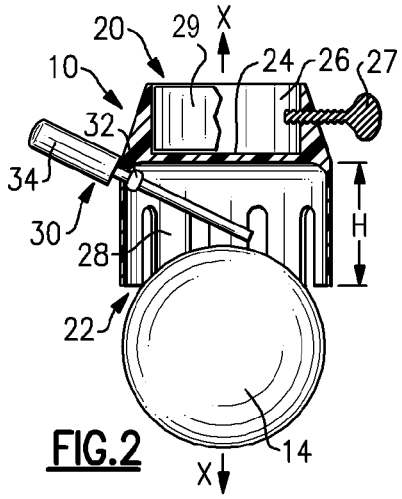
FIG. 2 is a side elevation, cross-sectional view of the present invention shown releasing a golf ball.
Figure 5:
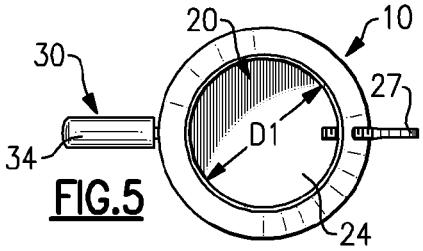
FIG. 5 is a top plan view of the present invention.
Figure 3:
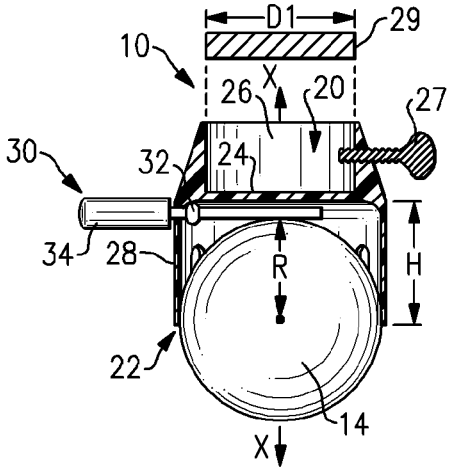
FIG. 3 is a side elevation, cross-sectional view of the present invention shown picking up a golf ball.
Figure 4:
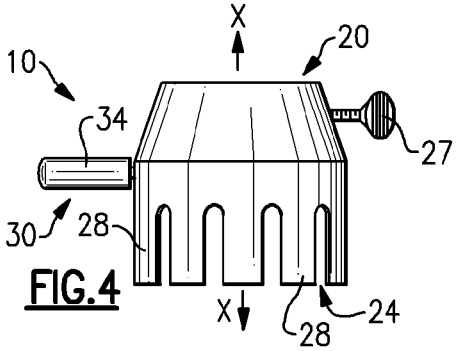
FIG. 4 is a side elevation view of the present invention.
Figure 3A:
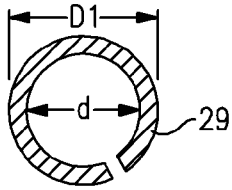
FIG. 3A is a plan view of a sizing ring.
Figure 6:
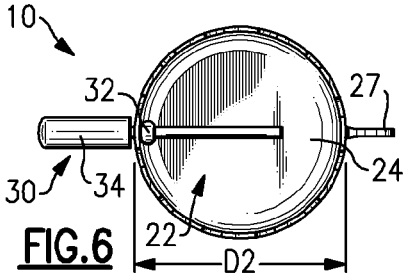
FIG. 6 is a bottom plan view of the present invention.

Referring now to the drawings, in which like reference numerals refer to like parts throughout, there is seen a golf ball gripping device, designated generally by reference numeral 10, adapted for secure connection to the grip end of a golf club 12 and for securely engaging a golf ball 14 in order to pick up and release the ball, without a golfer 16 having to bend over to physically manipulate the ball. In FIG. 1, device 10 is illustrated releasing ball 14 by golfer 16 manipulating the device with his foot 18, as will be further described hereinafter.

With reference to FIGS. 2-6, device 10 comprises a body 18 that extends along a longitudinal axis X-X, and includes a counter-sunk opening 20 formed in its upper end and a ball receiving cavity 22 formed in its lower end, with counter-sunk opening 20 being separated from ball receiving cavity 22 by a wall 24 that extends in a plane transverse to longitudinal axis X-X. Counter-sunk opening 20 is defined by a peripheral sidewall 26 that is of a predetermined diameter D1, that is approximately the same as a common putter grip diameter, such that device 10 can be securely placed on club 16. A wing nut 27 (or similar structure) may extend through device 10 and into counter-sunk opening 20 to permit golfer 12 to threadingly advance it against the club 12 to further secure the attachment. Ball receiving cavity 22 is defined by a plurality of annularly spaced apart ribs 28 that define a diameter D2 that is just slightly smaller than the diameter of a standard golf ball 14. Ribs 28 extend parallel to longitudinal axis X-X. The depth H of ball receiving cavity as defined by the distance from the free end of ribs 28 to wall 24 is slightly greater than the radius R of standard golf ball 14 for reasons that will be explained in greater detail hereinafter when describing the ball release mechanism.

Sizing rings 29 may be securely positioned within opening 20 to make the effective diameter d smaller in the event a putter grip having a diameter smaller than D is being used. Sizing rings 29 are preferably composed of resilient plastic and have outside diameters D (about the same as the diameter D of the opening 20), in order to permit secure placement of the ring in opening 20, and can have varying interior diameters d to accommodate different sized golf club grips.

Ribs 28 are composed of a material, such as plastic, that permits them to flex outwardly when engaging a golf ball 14. To securely retain golf ball 14 within cavity 22, the diameter D2 defined by ribs 22 is slightly less than the diameter of ball 14 and the depth H of cavity 22 is slightly greater than the radius R of ball 14, thereby ensuring that the ball is being engaged at its diameter (which occurs at a length equal to its radius). To engage ball 14, device 10 is positioned on club 12 (where it can remain) and cavity 22 is vertically aligned with ball 14. Once vertically aligned, device 10 can be lowered such that ball 14 engages cavity 22. Once ball 14 travels far enough into cavity 22 (i.e., once ball 14 travels a distance exceeding its radius), ribs 28 will frictionally retain ball 14 within cavity 22.

To release ball 14 from cavity 22, a release pin 30 is provided. Release pin 30 extends partially through an opening formed in device 10 that is positioned immediately adjacent wall 24 and in within cavity 22. The length of the portion of pin 30 that extends into cavity 22 is about equal to, or slightly greater than the radius R of ball 14, and a grommet 32 positioned on the portion of pin 30 within cavity 30, and a cap 34 positioned on the portion of pin 30 outside device 10 prevent pin 30 from sliding out of/disengaging device 10. As pin 30 is positioned partially within and partially outside of cavity 22, it is pivotally movable about its interface with device 10.

When ball 14 is retained within cavity 22, pin 30 is positioned in sandwiched relation between wall 24 and ball 14. To release ball 14 from cavity 22, golfer 16 simply pivotally moves pin 30 upwardly, such that the interior portion of pin 30 pushes outwardly against ball 14. The pushing movement of pin 30 against ball 14 forces ball 14 to push out from the frictional engagement of ribs 28. Once the diameter of ball 14 is outside the frictional engagement of ribs 14, device 10 no longer retains ball 14. Thus, golfer 16 can place club 12 and ball 14 in the position at which it is desired to release ball 14, and using his foot 18 push upwardly on pin 30, thereby releasing ball 14 in the desired position.

The present invention has been described with reference to a preferred embodiment. It should be understood that the scope and spirit of the present invention is defined by the appended claims and is not intended to be limited to the specific embodiment disclosed herein.

What is claimed is:

1. A device adapted for gripping a golf ball of a predetermined diameter and for use with a golf club having a grip with an end, the device comprising:

a. a body having a longitudinal axis and first and second opposing ends;

b. a first counter-sunk opening formed in said first end and defined by a resilient sidewall having a first diameter smaller than the predetermined diameter of the golf ball;

c. a second counter-sunk opening formed in said second end and adapted for secure engagement with the end of the grip; and d. a release pin movably mounted to said body and extending into said first counter-sunk opening along a first axis that is transverse to said longitudinal axis.

2. The device according to claim 1, wherein said release pin extends along a tangent that is coincident with the floor of said first counter-sunk opening.

3. The device according to claim 1, further comprising a set screw extending into said second counter-sunk opening and along a second axis that is transverse to said longitudinal axis.

4. The device according to claim 1, further comprising a set screw extending into said second counter-sunk opening and along a second axis that is transverse to said longitudinal axis.

5. The device according to claim 1, wherein said sidewall comprises a plurality of spaced apart ribs.

6. The device according to claim 5, wherein said ribs are spaced equidistant from one another.

7. The device according to claim 1, further comprising an insert adapted for secure positioning within said second counter-sunk opening.

8. The device according to claim 7, wherein said insert comprises a spilt ring.

9. A method for gripping and releasing a golf ball, comprising the steps of:

a. providing a device comprising:

i. a body having a longitudinal axis and first and second opposing ends;

ii. a first counter-sunk opening formed in said first end and defined by a resilient sidewall having a first diameter smaller than the predetermined diameter of the golf ball; and iii. a second counter-sunk opening formed in said second end and adapted for secure engagement with the end of the grip;

b. placing said first counter-sunk opening in vertical alignment with the ball; a c. pressing said device downwardly on the ball such that the ball is positioned within the first counter-sunk opening; and d. releasing the ball from said first counter-sunk opening comprises the steps of:

i. providing said device with a release pin movably mounted to said body and extending into said first counter-sunk opening along a first axis that is transverse to said longitudinal axis; and ii. moving said release pin to forcibly dislodge the ball from said first counter-sunk opening.

10. A device adapted for gripping a golf ball of a predetermined diameter and for use with a golf club having a grip with an end, the device comprising:

a. a body having a longitudinal axis and first and second opposing ends;

b. a first counter-sunk opening formed in said first end and defined by a resilient sidewall having a first diameter smaller than the predetermined diameter of the golf ball; and c. a release pin movably mounted to said body and extending into said first counter-sunk opening along a first axis that is transverse to said longitudinal axis.

11. The device according to claim 10, wherein said release pin extends along a tangent that is coincident with the floor of said first counter-sunk opening.

12. The device according to claim 10, wherein said sidewall comprises a plurality of spaced apart ribs.

13. The device according to claim 12, wherein said ribs are spaced equidistant from one another.

14. The device according to claim 10, further comprising means for mounting the device to the end of the grip.

15. The device according to claim 14, wherein said means for mounting the device to the end of the grip comprises a second counter-sunk opening formed in said second end and adapted for secure engagement with the end of the grip.

* * * * *